US009770075B2

(12) United States Patent
Sato

(10) Patent No.: US 9,770,075 B2
(45) Date of Patent: Sep. 26, 2017

(54) SLIDE-FASTENER OPENER, AND SLIDE FASTENER

(71) Applicant: YKK Corporation, Tokyo (JP)

(72) Inventor: Hideki Sato, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/129,488

(22) PCT Filed: Mar. 27, 2014

(86) PCT No.: PCT/JP2014/058719
§ 371 (c)(1),
(2) Date: Sep. 27, 2016

(87) PCT Pub. No.: WO2015/145642
PCT Pub. Date: Oct. 1, 2015

(65) Prior Publication Data

US 2017/0127771 A1 May 11, 2017

(51) Int. Cl.
*A44B 19/28* (2006.01)
*A44B 19/38* (2006.01)

(52) U.S. Cl.
CPC ..... *A44B 19/285* (2013.01); *A44B 19/38* (2013.01)

(58) Field of Classification Search
CPC ..... A44B 19/285; A44B 19/38; A44B 19/384; A44B 19/382; A44B 19/388
USPC ..... 24/436, 387, 388
See application file for complete search history.

(56) References Cited

U.S. PATENT DOCUMENTS 2,526,802 A 10/1950 Carlile
3,752,718 A * 8/1973 Potin ..... A44B 19/38 156/66
9,220,324 B1 12/2015 Nunn
2004/0205942 A1* 10/2004 Tsaur ..... A44B 19/388 24/433

(Continued)

FOREIGN PATENT DOCUMENTS

EP 0066253 A1 12/1982
JP S57-189411 12/1982

(Continued)

OTHER PUBLICATIONS

International Search Report, PCT International Patent Application No. PCT/JP2014/058719, dated Jun. 24, 2014.

*Primary Examiner* — Robert J Sandy
*Assistant Examiner* — Rowland Do
(74) *Attorney, Agent, or Firm* — Kilpatrick Townsend & Stockton LLP

(57) ABSTRACT

There is provided an opener of a slide fastener. A separable pin accommodation part of a retainer has upper and lower walls facing each other, a pair of wall parts protruding from the upper and lower walls in a direction of narrowing an interval therebetween, and a bottom wall configured to join the upper and lower walls at the rear of the pair of wall parts. The pair of wall parts extend toward the bottom wall from a rear side relative to front ends of the upper and lower walls. A pair of restriction parts are configured to collide with each other so as to restrict a position of a rearmost end of a separable pin to be inserted into a separable pin hole to a position between the bottom wall and front ends of the pair of wall parts are separately provided for the retainer and the separable pin.

7 Claims, 11 Drawing Sheets

(56) References Cited

U.S. PATENT DOCUMENTS

| | | | | |
|---|---|---|---|---|
| 2011/0296654 | A1 | 12/2011 | Sato | |
| 2014/0201958 | A1* | 7/2014 | Huang | A44B 19/36<br>24/435 |

FOREIGN PATENT DOCUMENTS

| | | | |
|---|---|---|---|
| JP | S63-073014 | | 5/1988 |
| WO | 2010-113275 | A1 | 10/2010 |
| WO | 2010-113281 | A1 | 10/2010 |

* cited by examiner

SLIDE-FASTENER OPENER, AND SLIDE FASTENER

This application is a national stage application of PCT/JP2014/058719, which is incorporated herein by reference.

TECHNICAL FIELD

The present invention relates to an opener having a separable pin provided at one fastener stringer of a pair of fastener stringers and a retainer provided at the other fastener stringer and having a separable pin hole through which the separable pin can be inserted and removed, and a slide fastener having the opener.

BACKGROUND ART

A usual slide fastener has a pair of left and right fastener stringers of which left and right facing side edge portions are provided with element rows, respectively, a slider configured to open and close the pair of element rows, and an opener provided at one end portion in a front-rear direction, which is a longitudinal direction of the pair of fastener stringers, in the vicinity of the pair of element rows. The opener generally has a separable pin provided at one fastener stringer of the pair of fastener stringers and a retainer provided at the other fastener stringer, and the retainer is formed with a separable pin hole for inserting one end portion of the separable pin on a surface (a front surface) facing the slider. The usual slider is configured to open and close the left and right fastener stringers by moving (advancing/retreating) the slider.

Also, a slider fastener has been known which can open (a state where the pair of element rows is not meshed with each other) the left and right fastener stringers by applying an external force to the left and right fastener stringers in the vicinity of the slider (more specifically, applying a pulling force for separation in a right-left direction) to remove one element row from the slider so as to open the left and right fastener stringers in a closed state (a state where the pair of element rows is meshed with each other) without moving the slider (Patent Document 1).

According to the fastener stringer, when the left and right fastener stringers are opened by the applied external force, the external force is applied not only to the pair of element rows but also to the opener. More specifically, after the pair of element rows is pulled apart and separated in the right-left direction, the external force is applied to the separable pin and retainer configuring the opener, so that the separable pin comes out of the separable pin hole while colliding with a sidewall covering a side surface of the separable pin hole of the retainer.

However, when the separable pin collides with the sidewall of the retainer while the separable pin comes out of the separable pin hole of the retainer, since the sidewall of the retainer completely interrupts lateral movement of the separable pin in a lateral direction, a separation property between the retainer and the separable pin is deteriorated and breakage of the retainer is caused. Therefore, the opener is required to have a structure capable of improving the separation property between the retainer and the separable pin to prevent the breakage of the retainer. In the meantime, the opener is originally required to have such a strength (hereinafter, referred to as 'lateral pulling strength of the opener') that the opener is not broken even when the external force is applied to the pair of fastener stringers of the slide fastener in the closed state from left and right sides in the vicinity of the opener.

An opener that may satisfy the above requirements to some extent has been known in which a tape groove is formed at a central portion in a width direction of the sidewall covering a side of the separable pin hole of the retainer and a groove width of an entrance-side (an entrance-side in a depth direction of the separable pin hole) of the tape groove is formed wider than an inner side (an inner side in the depth direction of the separable pin hole) (Patent Document 2).

More specifically, a pair of wall parts arranged at both sides of the tape groove are formed within a range from an inner position relative to an entrance of the separable pin hole to a bottom wall, not at the same position as the entrance of the separable pin hole. Therefore, in a case of the slide fastener having the opener, when pulling out the separable pin from the retainer by applying the external force, if the separable pin is pulled out from the separable pin hole to the portion at which the groove width of the tape groove is wide, it is thought that the separable pin can be easily moved in the lateral direction thereafter.

PRIOR ART DOCUMENT

Patent Document

Patent Document 1: International Patent Application Publication No. 2010/113275A
Patent Document 2: U.S. Pat. No. 2,526,802

SUMMARY OF INVENTION

Problems to be Solved by Invention

However, the opener has such a structure that the separable pin is inserted into the separable pin hole until it collides with the bottom wall so as to form the closed state, and is simply designed to move the separable pin in the depth direction of the separable pin hole for insertion and removal. That is, the opener is not designed for a using aspect of shifting the slide fastener in the closed state to the open state by the external force exerted in the right-left direction, and it is hard to say that in the case of the using aspect, it is considered to easily pull out the separable pin from the separable pin hole (the separation property between the retainer and the separable pin) and to make it difficult for the separable pin to break the retainer.

The present invention has been made in view of the above situations, and an object of the present invention is to provide an opener capable of, when shifting a slide fastener in a closed state to an open state by an external force exerted in a right-left direction, preventing breakage of a retainer as much as possible and improving a separation property between the retainer and the separable pin, and a slide fastener having the opener applied thereto.

Means for Solving Problems

An opener of a slide fastener of the present invention is used for a slide fastener configured to shift a pair of fastener stringers extending in a front-rear direction from a closed state to an open state by applying an external force in a right-left direction, which is a width direction thereof. The opener has a separable pin provided at a rear part of one of the fastener stringers and a retainer provided at a rear part of the other of the fastener stringers and having a separable pin accommodation part formed with a separable pin hole through which a separable pin can be inserted and removed. The separable pin accommodation part has an upper wall and a lower wall facing each other in an upper-lower direction, which is a thickness direction of the fastener stringer, a pair of wall parts protruding from the upper wall and the lower wall in a direction of narrowing an interval therebetween, and a bottom wall configured to join the upper wall and the lower wall at the rear of the pair of wall parts. Further, the pair of wall parts is formed to extend towards the bottom wall from a rear side relative to front ends of the upper wall and the lower wall, and a pair of restriction parts configured to collide with each other so as to restrict a position of a rearmost end of the separable pin to be inserted into the separable pin hole to a position between the bottom wall and front ends of the pair of wall parts are separately provided for the retainer and the separable pin.

In a state where the separable pin is accommodated in the separable pin accommodation part, a relation between a dimension from a rear end of the separable pin to the front ends of the pair of wall parts and a width dimension in the right-left direction of the separable pin hole may be arbitrary. When the pair of fastener stringers are shifted from the closed state to the open state by applying the external force, even though it is intended to pull out the separable pin from the separable pin accommodation part, the separable pin rotates about the front ends of the pair of wall parts, which are support points. In order to easily rotate the separable pin, a following configuration is preferable.

That is, in the state where the separable pin is accommodated in the separable pin accommodation part, the dimension from the rear end of the separable pin to the front ends of the pair of wall parts is set shorter than the width dimension in the right-left direction of the separable pin hole.

Also, a relation between a dimension in the front-rear direction of the separable pin to be accommodated in the separable pin accommodation part and the dimension from the rear end of the separable pin to the front ends of the pair of wall parts may be arbitrary. However, in order to further easily rotate the separable pin, a following configuration is preferable. That is, the dimension from the rear end of the separable pin to the front ends of the pair of wall parts is set to a half or less of the dimension in the front-rear direction of the separable pin to be accommodated in the separable pin accommodation part.

Also, a following configuration is preferable so that the pair of restriction parts does not influence an outward appearance of the opener in the closed state as much as possible.

That is, one of the restriction parts is a rear end portion of the separable pin, and the other of the restriction parts is a pair of restriction walls protruding from the opposing surfaces of the upper wall and the lower wall between the bottom wall and the front ends of the pair of wall parts.

Mutually opposing surfaces of the separable pin accommodated in the separable pin hole and the pair of wall parts may be arbitrary surfaces with respect to the right-left direction. However, as described above, the opener is originally required to have the lateral pulling strength. In order to improve the lateral pulling strength, a following configuration is preferable. That is, the mutually opposing surfaces of the separable pin and the pair of wall parts are planar surfaces orthogonal to the right-left direction.

In the front-rear direction between the pair of wall parts, the bottom wall may be located at a position coinciding with a rear end of a tape to which the separable pin of the fastener stringer is fixed. However, in order to make it difficult for the tape, to which the separable pin is fixed, to contact the bottom wall upon the rotation of the separable pin, a following configuration is preferable.

That is, in the front-rear direction between the pair of wall parts, the bottom wall is disposed at the rear of the rear end of a tape to which the separable pin of the fastener stringer is fixed.

As a slide fastener to which the opener is to be applied, a following slide fastener may be exemplified. That is, the slide fastener has a pair of fastener stringers extending in the front-rear direction, the above-described opener and a slider configured to move along a pair of element rows provided at opposing side edge portions of the pair of fastener stringers. Further, when an external force in the right-left direction is applied to the pair of fastener stringers in which the pair of element rows are meshed with each other, in the vicinity of the slider, at least one of an upper blade and a lower blade of the slider, which face each other in the upper-lower direction, is bent, so that one of the element rows is laterally pulled out from between the upper blade and the lower blade and the pair of element rows are thus separated.

Advantageous Effects of Invention

According to the opener of the present invention, when the separable pin is inserted into the separable pin hole, the pair of restriction parts collides with each other, so that the position of the rearmost end of the separable pin is restricted to the position between the bottom wall and the front ends of the pair of wall parts. Therefore, as compared to a configuration where the separable pin is inserted into the separable pin hole up to a depth reaching the bottom wall, it is possible to shorten an insertion length of the separable pin. As a result, upon the shift from the closed state to the open state, the separable pin can easily rotate about the front ends of the pair of wall parts, which are support points, so that it is possible to prevent the breakage of the retainer as much as possible and to improve the separation property between the retainer and the separable pin.

Also, in the opener where the dimension from the rear end of the separable pin to the front ends of the pair of wall parts is set shorter than the width dimension in the right-left direction of the separable pin hole at the state where the separable pin is accommodated in the separable pin accommodation part, the separable pin can more easily rotate about the front ends of the pair of wall parts, which are support points, upon the shift from the closed state to the open state.

Also, in the opener where the dimension from the rear end of the separable pin to the front ends of the pair of wall parts is set to a half or less of the dimension in the front-rear direction of the separable pin to be accommodated in the separable pin accommodation part, the separable pin can more easily rotate about the front ends of the pair of wall parts, which are support points, upon the shift from the closed state to the open state.

Also, in the opener where one restriction part is the rear end portion of the separable pin and the other restriction part is the pair of restriction walls formed from the opposing surfaces of the upper wall and the lower wall at the front of the bottom wall, the pair of restriction parts does not influence an outward appearance of the opener in the closed state.

In the opener where the mutually opposing surfaces of the separable pin and the pair of wall parts are planar surfaces orthogonal to the right-left direction, it is possible to improve the lateral pulling strength of the opener.

Also, in the opener where in the front-rear direction between the pair of wall parts, the bottom wall is disposed at the rear of the rear end of the tape to which the separable pin of the fastener stringer is fixed, the tape is difficult to contact the bottom wall when the separable pin rotates upon the shift from the closed state to the open state, so that the separable pin can more easily rotate.

EMBODIMENTS OF INVENTION

Figure 1:
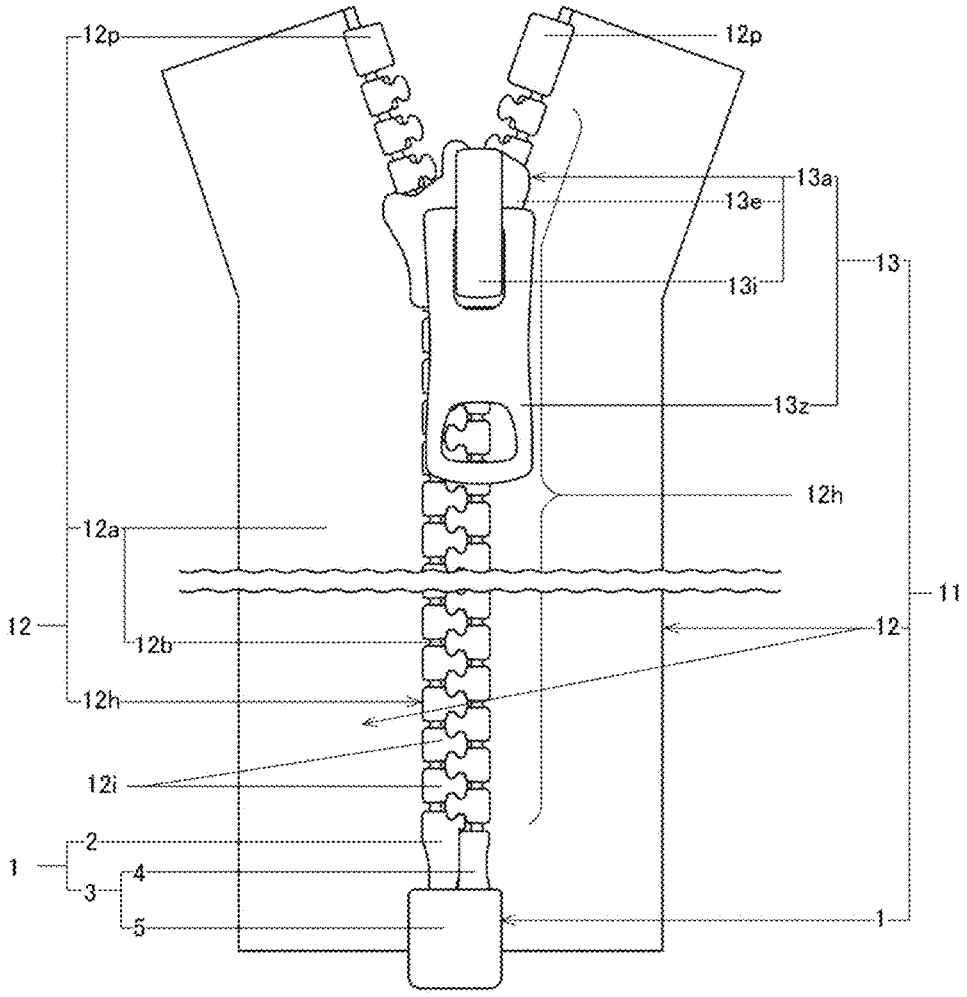
FIG. 1 is a plan view depicting a slide fastener according to a first illustrative embodiment of the present invention.
Figure 2:
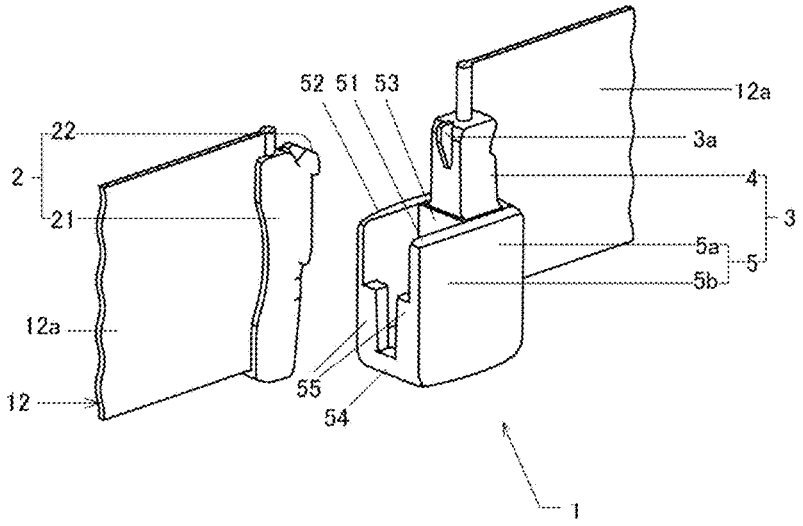
FIG. 2 is a perspective view depicting an opener that is to be used for the slide fastener of the first illustrative embodiment.
Figure 3:
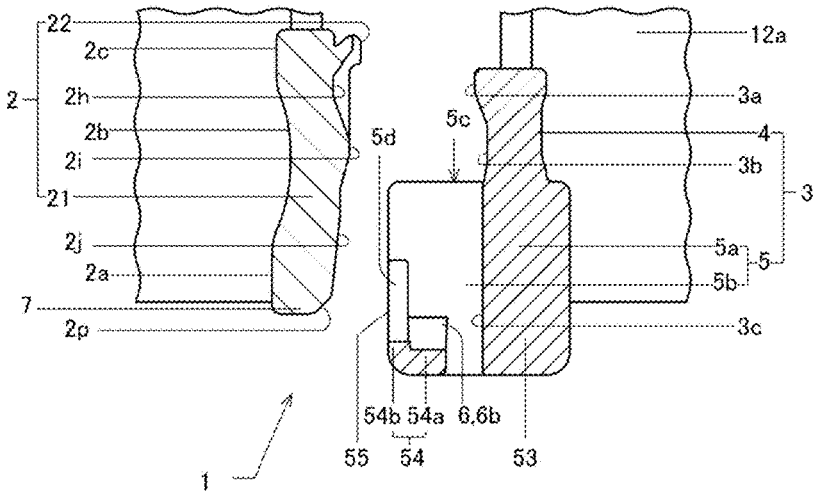
FIG. 3 is a sectional view depicting a state where the opener to be used for the slide fastener of the first illustrative embodiment is in an open state, as seen from above.

As shown in FIG. 1, a slide fastener 11 according to a first illustrative embodiment of the present invention includes a pair of fastener stringers 12, 12 extending in a front-rear direction and arranged in a right-left direction, a slider 13 configured to be moveable along left and right facing side edge portions of the pair of fastener stringers 12, 12, and an opener 1 configured to couple or decouple the other fastener slider 12 with respect to the slider 13 moveably attached to one fastener stringer 12 at a position adjacent to the rear of a movement range of the slider 13. When the slider 13 is moved in the front-rear direction with the pair of fastener stringers 12, 12 being coupled by the opener 1, the pair of fastener stringers 12, 12 can be opened or closed. When describing the direction in the below, a front side is an upper side of FIG. 1 and a direction (a wide side of the slider 14 and a side at which elements 12*i* to be described later are to be separated) in which the slider 13 closes the pair of fastener stringers 12, 12, and a rear side is a lower side of FIG. 1 and a direction (a narrow side of the slider 13 and a side at which the elements 12*i* to be described later are to be meshed with each other) in which the slider 13 opens the pair of fastener stringers 12, 12. Also, the front-rear direction is referred as a longitudinal direction in the descriptions of the fastener stringer 12. Also, a direction which is orthogonal to the front-rear direction and along which the pair of fastener stringers 12, 12 is arranged is the right-left direction (width direction), and a direction orthogonal to the front-rear direction and the right-left direction is the upper-lower direction (a thickness direction of the fastener stringer 12). A left side is a left side of FIG. 1, and a right side is a right side of FIG. 1. An upper side is a direction orthogonal to the drawing sheet of FIG. 1, i.e., a front side of the direction orthogonal to the front-rear direction and the right-left direction, and a lower side is an inner side of the direction orthogonal to the drawing sheet of FIG. 1.

The pair of fastener stringers 12, 12 has a pair of tapes 12*a*, 12*a* extending in the front-rear direction and arranged in parallel with each other in the right-left direction, a pair of element rows 12*h*, 12*h* fixed along left and right facing side edge portions of the pair of tapes 12*a*, 12*a*, and a pair of stops 12*p*, 12*p* for defining an advancing limit position of the slider 13 at a position adjacent to the front of the movement range of the slider 13.

Each tape 12*a* has a strip shape long in the front-rear direction, and a thickness direction thereof is the upper-lower direction. Also, each tape 12*a* has a core part 12*b* thicker than the other side edge portion at one of the left and right side edge portions.

Each element row 12*h* is formed by a plurality of elements 12*i* arranged at intervals in the front-rear direction along the facing side edge portion of the tape 12*a*. In the first illustrative embodiment, the plurality of elements 12*i* is respectively independent, and each element 12*i* is fixed to the core part 12*b*. When the slider 13 is moved forward so as to close the pair of fastener stringers 12, 12, the elements 12*i* of the pair of element rows 12*h*, 12*h* are meshed with each other, the meshed elements 12*i* come out of the rear side of the slider and the slider 13 finally collides with the stops 12*p*, so that further forward movement of the slider 13 is prevented. Also, when the slider 13 is moved rearward so as to open the pair of fastener stringers 12, 12, the elements 12*i* of the pair of element rows 12*h*, 12*h* are separated in the right-left direction, the separated elements 12*i* come out of the front side of the slider and the slider 13 finally collides with the opener 1, so that further rearward movement of the slider 13 is prevented.

Each stop 12*p* is fixed to a front end portion of each tape 12*a*, and more specifically, is fixed in front of the element row 12*h* at an interval. Also, each stop 12*p* is thicker than the element 12*i* and is configured to collide with a front surface of the slider 13.

As shown in FIGS. 1 and 6 to 8, the slider 13 has a slider body 13*a* configured to engage with the pair of element rows 12*h*, 12*h* and to be moveable in the front-rear direction, and a pull-tap 13*z* coupled to the slider body 13*a*.

The slider body 13*a* is formed with an element path 13*b* penetrating in the front-rear direction and a pair of tape insertion paths 13*c*, 13*c* configured to communicate with the element path 13*b* and to open in the right-left direction. The pair of element rows 12*h*, 12*h* passes through the element path 13*b*, and the tape 12*a* passes through the corresponding tape insertion path 13*c*. Also, the slider body 13*a* has an upper blade 13*e* and a lower blade 13*f* configured to face each other in the upper-lower direction, a connecting post 13*h* configured to couple the upper blade 13*e* and the lower blade 13*f* therebetween at inner portions in the width direction of front portions thereof, a pull-tap attachment portion 13*i* protruding upward from an inner portion in the width direction of an upper surface of the upper blade 13*e*, and flanges 13*p* protruding from at least one of the upper blade 13*e* and the lower blade 13*f* at both outer portions in the width direction of the upper blade 13*e* and the lower blade 13*f*, in directions along which an interval between the upper blade 13*e* and the lower blade 13*f* narrows.

The upper blade 13*e* and the lower blade 13*f* have an unsymmetrical shape with respect to the right-left direction, respectively. A front end of an opposite side to a front end of one side (a right side, in FIG. 1) of the left and right is arranged at the rear, and a width dimension of the front end of the opposite side is set substantially to be the same as a width dimension of the front end of the one side. Also, the upper blade 13*e* and the lower blade 13*f* are respectively formed so that left and right ends are gradually arranged at a central side in the right-left direction as they face toward the rear. In other words, the width is narrower at the rear portion than at the front portion.

The flanges 13*p* are respectively formed at both left and right end portions of the upper blade 13*e* and the lower blade 13*f*. The tape insertion path 13*c* is formed between the pair of flanges 13*p*, 13*p* facing each other in the upper-lower direction, and a width in the upper-lower direction of the tape insertion path 13*c* is greater than a thickness of the tape 12*a* and is smaller than a thickness of the element 12*i*. Also, an interval of the tape insertion path 13*c* formed between the pair of flanges 13*p*, 13*p* of one side (the right side, in FIGS. 1 and 7) with respect to the right-left direction is narrower than an interval of the tape insertion path 13*c* formed between the pair of flanges 13*p*, 13*p* of an opposite side (the left side, in FIGS. 1 and 7). Therefore, protruding lengths of the pair of flange 13*p*, 13*p* of one side with respect to the right-left direction in directions along which an interval therebetween narrows are longer than protruding lengths of the pair of flange 13*p*, 13*p* of the opposite side in directions along which an interval therebetween narrows. Further, side surfaces of the pair of flanges 13*p*, 13*p* of the narrower side, which face the element path 13*b*, are configured as inclined surfaces 13*q* with respect to the upper-lower direction, and the inclined surfaces 13*q* are configured as inclined surfaces facing toward the connecting post as they are spaced from the tape insertion path 13*c* in the upper-lower direction.

The pull-tap attachment portion 13*i* is formed at a position deviating from a center in the width direction of the upper blade 13*e*, with respect to the right-left direction.

The pull-tap attachment portion 13*i* is formed with a through-hole (not shown) penetrating in the right-left direction. A part of the pull-tap 13*z* is inserted into the through-hole, so that the pull-tap 13*z* is swingably coupled to the slider body 13*a*.

The slider 13 is to enable one of the pair of fastener stringers 12, 12 to separate laterally from the tape insertion path 13*c*. More specifically, when an external force is applied to the pair of fastener stringers 12, 12 of which the pair of element rows 12*h*, 12*h* is meshed, in the vicinity of the slider 13, the elements 12*i* are pressed to the inclined surfaces 13*q* of the pair of flanges 13*p*, 13*p* at the tape insertion path 13*c* having the wider interval, so that the upper blade 13*e* and the lower blade 13*f* are bent, the interval of the tape insertion path 13*c* having the wider interval is forcibly widened and the elements 12*i* are thus separated.

As shown in FIGS. 1 to 5, the opener 1 includes a separable pin 2 provided at the rear part of the one (left side, in FIG. 1) fastener stringer 12 and a retainer 3 provided at the rear part of the other (right side, in FIG. 1) fastener stringer 12, and the separable pin 2 is configured to be inserted and removed into and from the retainer 3.

The separable pin 2 is fixed to the core part 12*b* of the tape 12*a* of the one fastener stringer 12 in the vicinity of the rear of the element row 12*h*.

The separable pin 2 has a separable pin main body portion 21 extending in the front-rear direction, as a main, and a meshing protrusion 22 protruding from a front end portion of a surface, which faces toward a retainer pin (which will be described later), of left and right side surfaces of the separable pin main body portion 21 and configured to engage with the element 12*i* of a rearmost end of the element row 12*h* facing toward the retainer pin.

A surface, which is opposite to the retainer pin 4, of the left and right side surfaces of the separable pin 2 has a rear end portion, which is a first surface 2*a* having a planar surface shape and extending linearly in the front-rear direction, a front end portion, which is a third surface 2*c* having a planar surface shape and extending in the front-rear direction, and an intermediate portion, which is a second surface 2*b* positioned between the front end portion and the rear end portion and having a curved surface shape recessed in an arc shape. Also, at a state where the separable pin 2 is inserted into the retainer 3 (a state where the opener 1 is closed), a front end of the first surface 2*a* having a planar surface shape is positioned between front ends of a pair of wall parts 55, 55 (which will be described later) of the retainer 3 and front ends of an upper wall 51 and a lower wall 52 (which will be described later) of the retainer 3 (refer to FIG. 4).

Also, a surface, which faces toward the retainer pin, of the left and right side surfaces of the separable pin 2 has a first engagement surface 2*i*, which is provided within a predetermined range from a front part of the corresponding surface to the rear of the meshing protrusion 22 and is configured to contact the retainer 3, an engagement groove 2*h* recessed in an arc shape and formed at a central portion in the upper-lower width direction between the meshing protrusion 22 and the first engagement surface 2*i*, and a part positioned at the rear of the first engagement surface 2*i*, that is, a rear part that is a second inclined surface 2*j* inclined in the front-rear direction. More specifically, the second inclined surface 2*j* is inclined in a direction of separating from the retainer pin 4 with respect to the right-left direction as it faces rearward. Also, a corner part of the second inclined surface 2*j* and the rear end face of the separable pin 2 is configured as a chamfered rounded corner surface 2*p*. The rounded corner surface 2*p* is inclined so that it separates more sharply from the retainer pin 4 than the second inclined surface 2*j* with respect to the right-left direction as it faces rearward.

The retainer 3 has a retainer pin 4, which is provided at the core part 12*b* of the tape 12*a* of the other fastener stringer 12 in the vicinity of the rear of the element row 12*h*, and a retainer body 5 joined to the rear of the retainer pin 4. The retainer pin 4 and the retainer body 5 are integrally formed. Also, the retainer pin 4 is fixed to the core part 12*b* of the tape 12*a* of the other fastener stringer 12.

The retainer pin 4 has a length in the front-rear direction, which is substantially a half of a length in the front-rear direction of the separable pin 2. A surface, which faces toward the separable pin, of left and right side surfaces of the retainer pin has a first engaged surface 3*b*, which is configured to contact the first engagement surface 2*i* and is a planar surface orthogonal to the right-left direction. More specifically, the first engaged surface 3*b* is a planar surface of which a part except for a rear part of the retainer pin 4 is orthogonal to the right-left direction, and is configured as an inclined surface facing toward the separable pin as the rear part of the retainer pin 4 faces rearward. Also, a central portion in the upper-lower width direction of the first engaged surface 3*b* is formed with an engagement protrusion 3*a* configured to be fitted into the engagement groove 2*h* of the separable pin 2 and protruding toward the separable pin.

The retainer body 5 has a retainer pin joining part 5*a* to which the retainer pin 4 is joined to protrude forward at one side (right side, in FIG. 1) of left and right sides and a separable pin accommodation part 5*b* configured to accommodate the rear part of the separable pin 2 into a separable pin hole 5*c* at an opposite side (left side, in FIG. 1) of the left and right sides.

The retainer pin joining part 5*a* has a rod shape extending in the front-rear direction and is thicker than the retainer pin 4 (a width dimension in the right-left direction is greater). Also, a front surface of the retainer pin joining part 5*a* is a surface to which a rear surface of the retainer pin 4 is joined, and protrudes beyond the retainer pin 4 in the upper, the lower and the opposite side of the left and right sides to the separable pin 2. Also, a surface, which faces toward the separable pin hole, of left and right side surfaces of the retainer pin joining part 5*a* is a second engaged surface 3*c*, which is a planar surface facing the second inclined surface 2*j* of the separable pin 2 and orthogonal to the right-left direction.

The separable pin accommodation part 5*b* is formed at a front surface thereof with the separable pin hole 5*c* configured to accommodate therein the rear part of the separable pin 2. Also, an inner side of the separable pin hole 5*c* penetrates rearward the retainer pin joining part with respect to the right-left direction and blocks an opposite side to the retainer pin joining part 5*a* (hereinafter, referred to as 'retainer pin joining part-opposite side) with respect to the right-left direction. Moreover, the separable pin accommodation part 5*b* is formed on a surface, which is opposite to the retainer pin joining part, of left and right side surfaces with a tape groove 5*d* configured to communicate with the separable pin hole 5*c*, and the tape 12*a* protruding from the side surface of the separable pin 2 inserted into the separable pin hole 5*c* is to be inserted into the tape groove 5*d*.

The retainer body 5 has an upper wall 51 and a lower wall 52, which face each other in a thickness direction (the upper-lower direction, which is a thickness direction of the tape 12*a*) of the fastener stringers 12 facing in the upper-lower direction, an inner wall 53 configured to join the upper wall 51 and the lower wall 52 therebetween over entire lengths thereof in the front-rear direction in an entire length of the retainer pin joining part 5*a* with respect to the right-left direction, a bottom wall 54 configured to join the upper wall 51 and the lower wall 52 therebetween with an interval from a rear part of the inner wall 53 in the right-left direction, and a pair of wall parts 55, 55 protruding from the upper wall 51 and the lower wall 52 in a direction of narrowing an interval therebetween at the retainer pin joining part-opposite side with respect to the right-left direction. Also, front ends of the pair of wall parts 55, 55 are positioned at the rear of the front ends of the upper wall 51 and the lower wall 52, and rear ends of the pair of wall parts 55, 55 are joined to a retainer pin joining part-opposite side part of the bottom wall 54 extending in the right-left direction and are not joined to a part facing the retainer pin joining part.

The parts of the upper wall 51 and the lower wall 52, which are joined to the inner wall 53, and the inner wall 53 configure the retainer pin joining part 5*a*. Also, the parts of the upper wall 51 and the lower wall 52, which are not joined to the inner wall 53, a surface, which faces toward the separable pin hole, of the side surfaces of the inner wall 53, the pair of wall parts 55, 55, the bottom wall 54 and a pair of restriction walls 6*a*, 6*b* (which will be described later) configure the separable pin accommodation part 5*b*. Also, a space is formed between the upper wall 51 and the lower wall 52 at the retainer pin joining part-opposite side with respect to the right-left direction. The space includes a space of the tape groove 5*d* between the pair of wall parts 55, 55 and a space of the separable pin hole 5*c*, which is a part except for the tape groove 5*d*. That is, the space of the separable pin hole 5*c* is a space between the upper wall 51 and the lower wall 52, and is a part except for the space between the pair of wall parts 55, 55.

The upper wall 51 and the lower wall 52 are rectangular plates having the same size.

A surface, which faces toward the separable pin hole, of side surfaces of the inner wall 53 is a planar surface orthogonal to the right-left direction.

The bottom wall 54 has a bottom wall-horizontally extending portion 54*a* extending in the right-left direction and a bottom wall-vertically extending portion 54*b* extending forward from a part, which is an opposite side to the retainer pin joining part 5*a* with respect to the right-left direction, of the bottom wall-horizontally extending portion 54*a* toward the pair of wall parts 55, 55.

The pair of wall parts 55, 55 is rectangular plates. Also, surfaces, which face toward the retainer pin joining part 5*a*, of side surfaces of the pair of wall parts 55, 55 are planar surfaces orthogonal to the right-left direction.

Also, the opener 1 has a pair of restriction parts 6, 7 separately provided for the retainer 3 and the separable pin 2 and configured to restrict a position of the rearmost end of the separable pin 2 inserted into the separable pin hole 5*c* to a position between the bottom wall 54 and the front ends of the pair of wall parts 55, 55. In the meantime, the 'position between the bottom wall 54 and the front ends of the pair of wall parts 55, 55' means a position in front of a position of the forefront end of the bottom wall 54 and at the rear of positions of forefront ends of the pair of wall parts 55, 55. Also, one restriction part 7 is a rear end portion of the separable pin 2 and the other restriction part 6 is a pair of restriction walls 6*a*, 6*b* formed to face opposing surfaces (surfaces facing toward the separable pin hole) of the upper wall 51 and the lower wall 52 at the front of the bottom wall 54.

The upper restriction wall 6*a* has a rear end joined to the bottom wall 54 and an opposite side to the retainer pin joining part 5*a* joined to the upper wall part 55. In the meantime, the lower restriction wall 6*b* also has a rear end joined to the bottom wall 54 and an opposite side to the retainer pin joining part 5*a* joined to the lower wall part 55. Also, a downward protruding length of the upper restriction wall 6*a* with respect to the upper wall 51 is equal to or less than a downward protruding length of the upper wall part 55 with respect to the upper wall 51, and is shorter than the downward protruding length of the upper wall part 55 with respect to the upper wall 51, in the shown example. In the meantime, an upward protruding length of the lower restriction wall 6*b* with respect to the lower wall 52 is equal to or less than an upward protruding length of the lower wall part 55 with respect to the lower wall 52, and is shorter than the upward protruding length of the lower wall part 55 with respect to the lower wall 52, in the shown example. Also, each of the restriction walls 6*a*, 6*b* has a rectangular shape, as seen from the upper-lower direction, an end facing toward the retainer pin with respect to the right-left direction is matched with an end of the bottom wall 54, and a front end with respect to the front-rear direction is positioned between the front end and the rear end of the wall part 55, more specifically, at the slight rear of a center in the front-rear length of the wall part 55.

The slide fastener 11 is used in following order when shifting the pair of fastener stringers 12, 12 from an open state to a closed state.

(1) The slider 13 is retreated until it collides with the retainer body 5, the separable pin 2 is inserted into the element path 13*b* formed in the slider 13, and the rear part of the separable pin 2 is inserted into the separable pin hole 5*c* of the retainer body 5. By doing so, the rear end of the separable pin 2 collides with the pair of restriction walls 6*a*, 6*b*, and the position of the rearmost end of the separable pin 2 inserted into the separable pin hole 5*c* is restricted.

(2) When the slider 13 is advanced from the restricted state, the pair of element rows 12*h*, 12*h* is meshed with each other and the opener 1 is in the closed state, as shown in FIG. 1. In the meantime, the pair of element rows 12*h*, 12*h* is meshed with each other, so that the position of the rear end of the separable pin 2 is moved forward slightly beyond the pair of restriction walls 6*a*, 6*b*, as shown in FIG. 4.

Figure 4:
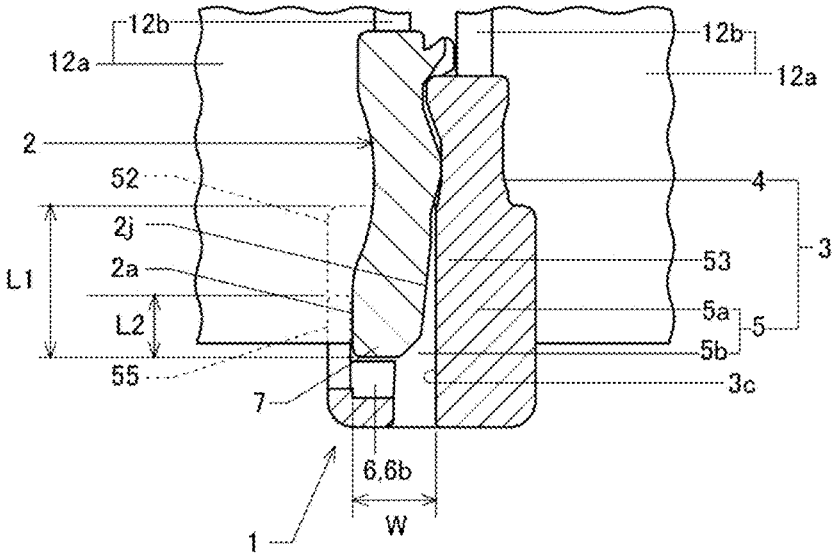
FIG. 4 is a sectional view depicting a state where the opener to be used for the slide fastener of the first illustrative embodiment is in a closed state, as seen from above.

Also, as shown in FIG. 4, in the closed state of the opener 1, the front part of the separable pin 2 and the retainer pin 4 are aligned with being contacted to each other right and left, a slight gap is formed between the surface of the rear part of the separable pin 2, which faces toward the retainer pin joining part 5*a*, and the inner wall 53 of the retainer pin joining part 5*a*, and the gap is formed to be gradually enlarged toward the rear. Also, a dimension (maximum dimension) L2 from the rear end of the separable pin 2 to the front ends of the pair of wall parts 55, 55 is set to a half or less of a dimension L1 in the front-rear direction of the separable pin 2 accommodated in the separable pin accommodation part 5*b* (in other words, a maximum dimension L1 from the rear end of the separable pin 2 to the front end of the separable pin accommodation part 5*b* (the front ends of the upper wall 51 and the lower wall 52)), preferably a length of ⅓ L1 to ½ L1. That is, a relation of ½ L1≥L2, preferably ⅓ L1≤L2≤½ L1 is satisfied. Also, in the closed state of the opener 1, the dimension L2 from the rear end of the separable pin 2 to the front ends of the pair of wall parts 55, 55 is shorter than a width dimension W (maximum width dimension) in the right-left direction of the separable pin hole 5*c*. That is, a relation of L2<W is satisfied.

Also, since the mutually opposing surfaces of the rear part of the separable pin 2 and the pair of wall parts 55, 55, i.e., the first surface 2*a* of the separable pin 2 and the surfaces of the pair of wall parts 55, 55 facing the first surface 2*a* are configured as the planar surfaces orthogonal to the right-left direction, when the external force is applied to the opener 1 in the closed state, the planar surfaces collide each other, so that it is possible to improve the lateral pulling strength of the opener 1. In the meantime, it is not possible to see the pair of restriction parts 6, 7 with naked eyes in the closed state of the opener 1. Therefore, an outward appearance of the opener 1 is not influenced by the pair of restriction parts 6, 7. In the meantime, within the range between the pair of wall parts 55, 55 with respect to the right-left direction, the bottom wall 54 is arranged at the rear of the rear end of the tape 12*a* to which the separable pin 2 is fixed, more specifically, at the rear of the front ends of the pair of restriction walls 6*a*, 6*b*.

Figure 5:
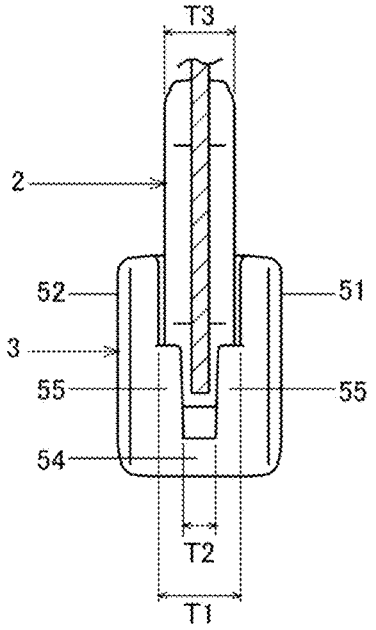
FIG. 5 is a side view depicting a state where the opener to be used for the slide fastener of the first illustrative embodiment is in the closed state, as seen from a separable pin-side.
Figure 6:
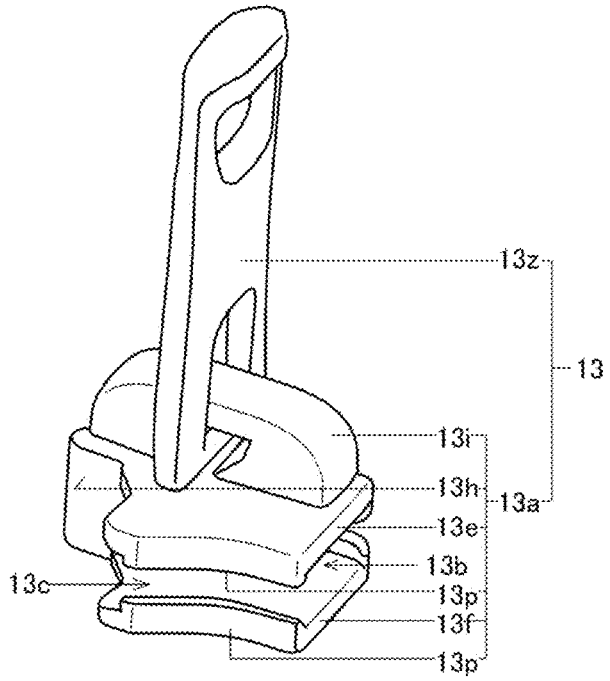
FIG. 6 is a perspective view depicting a slider that is to be used for the slide fastener of the first illustrative embodiment.
Figure 7:
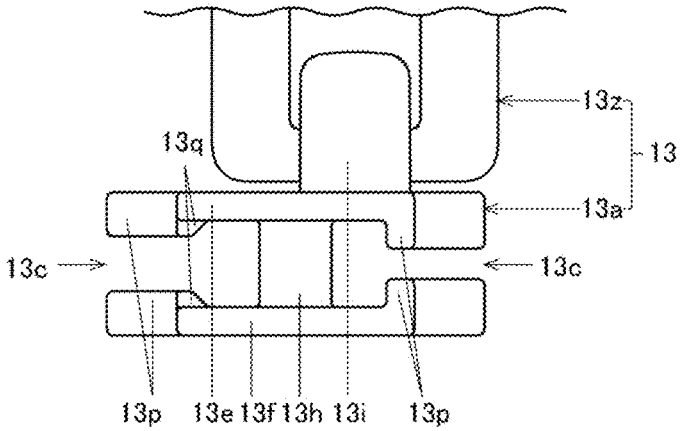
FIG. 7 depicts the slider that is to be used for the slide fastener of the first illustrative embodiment, as seen from rear.

Also, as shown in FIG. 5, a spaced dimension T1 (maximum spaced dimension) between the upper wall 51 and the lower wall 52, a width dimension (maximum width dimension, which is a spaced dimension between the pair of wall parts 55, 55) T2 of the tape groove 5*d*, and a thickness dimension (maximum width dimension, which is a width dimension in the upper-lower direction) T3 of the separable pin 2 are formed to satisfy a relation of T2<T3<T1.

Subsequently, when shifting the pair of fastener stringers 12, 12 from the closed state to the open state without moving the slider 13 relative to the slide fastener 11, the slide fastener is used in following order.

Figure 9A:
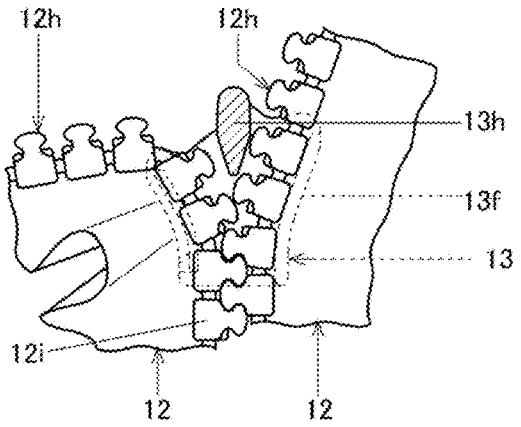
FIGS. 9A to 9C illustrate a process of separating a pair of element rows by the external force.

(1) As shown in FIG. 9A, the external force is applied to the left and right fastener stringers 12 in the vicinity of the slider 13 (more specifically, the pulling force is applied so as to separate the fastener stringers in the right-left direction).

Figure 8:
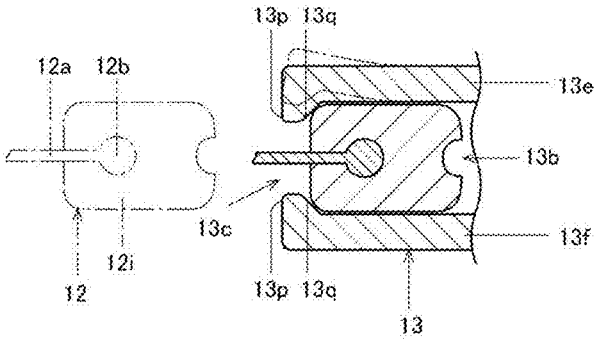
FIG. 8 is a sectional view depicting a state where an element is removed from the slider by an external force.
Figure 9B:
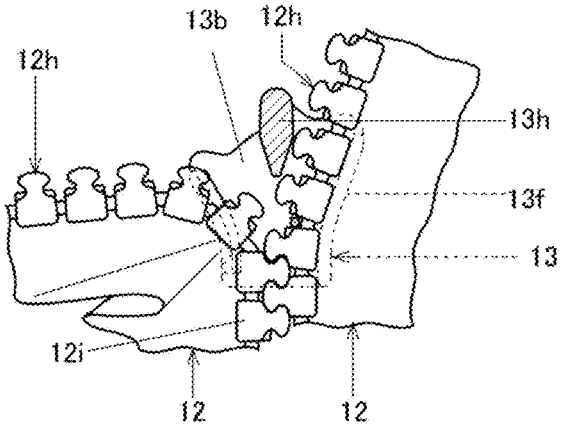

(2) As a result, as shown in FIG. 9B, the element row 12*h* positioned on the path having the greater width in the upper-lower direction of the left and right tape insertion paths 13*c* intends to come out of the tape insertion path 13*c* having the greater width in the upper-lower direction, and the force is transmitted from the elements 12*i* of the element row 12*h* to the upper and lower blades 13*e*, 13*f*, so that at least one of the upper blade 13*e* and the lower blade 13*f* is bent. In the meantime, in FIG. 8, the bending of the upper blade 13*e* is shown with the dashed-dotted line.

Figure 9C:
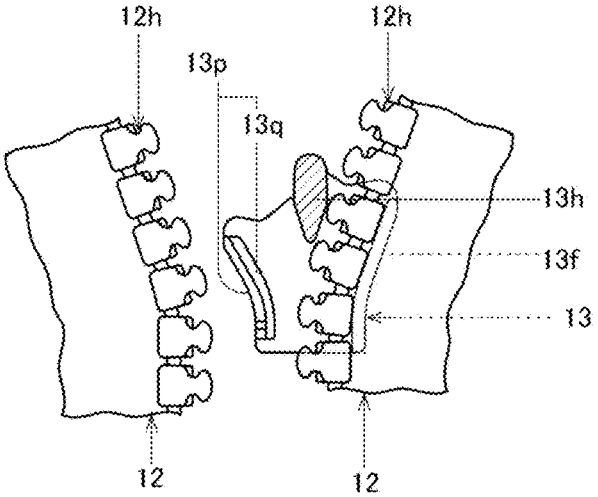

(3) Thereby, as shown in FIG. 9C, the one element row 12*h* is removed from the slider 13, and the pair of element rows 12*h*, 12*h* is separated in the right-left direction in the vicinity of the slider 13 (refer to FIG. 8).

(4) When the external force is applied to the pair of fastener stringers 12, 12 at the above state, the pair of element rows 12*h*, 12*h* is gradually separated toward the opener 1.

Figure 10A:
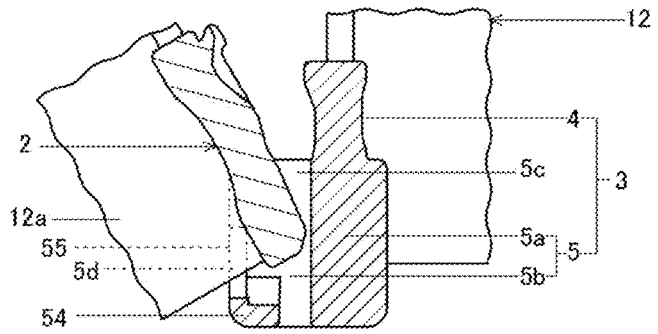
FIGS. 10A to 10C are sectional views depicting a process of opening the opener by the external force, as seen from above.

(5) When the opener 1 is also applied with the external force, since the gap of which the width gradually increases toward the rear is formed between the separable pin 2 and the retainer pin joining part 5*a* (inner wall 53), as shown in FIG. 4, the separable pin 2 is rotated about the front ends of the pair of wall parts 55, 55, which are support points, the front part of the separable pin 2 becomes distant laterally from the retainer pin 4 and the rear end of the separable pin 2 comes close to the retainer pin joining part, as shown in FIG. 10A.

Figure 10B:
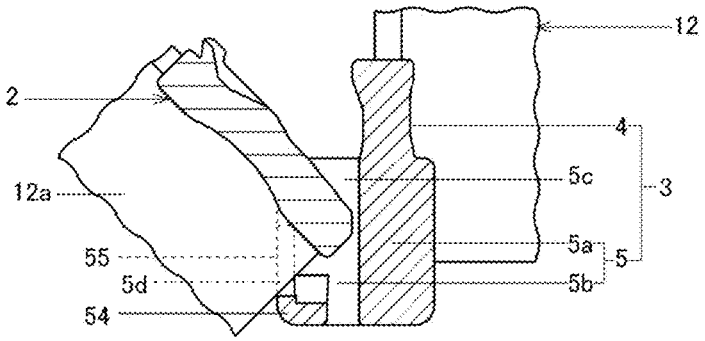

(6) When the external force is further applied to the opener 1, the separable pin 2 is further rotated, as shown in FIG. 10B. At this time, the separable pin 2 is rotated without colliding or substantially colliding with the inner wall 53 due to the relation of L2<W, and the relation of ½ L1≥L2 (preferably, ⅓ L1≤L2≤½ L1). Therefore, the breakage of the retainer body 5 is suppressed and the separation property between the separable pin 2 and the retainer body 5 is improved. Also, as the separable pin 2 is rotated, the tape 12*a* to which the separable pin 2 is fixed is also rotated. Since the rear ends (the rear end of the tape groove 5*d*=the front end of the bottom wall 54) of the pair of wall parts 55, 55 are located at the rear of the front ends of the pair of restriction walls 6*a*, 6*b*, the rear end of the rotated tape 12*a* is difficult to contact the front end of the bottom wall 54 (in the shown example, the contact is not made). Therefore, the breakage of the tape 12*a* is suppressed.

Figure 10C:
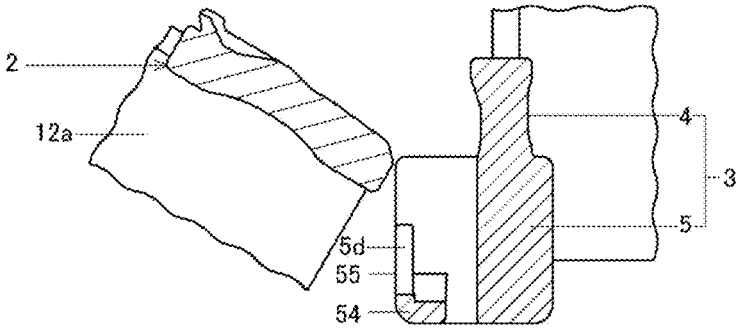

(7) When the external force is further applied to the opener 1, the rear part of the separable pin 2 is completely separated from the separable pin accommodation part 5*b*, as shown in FIG. 10C.

Figure 11A:
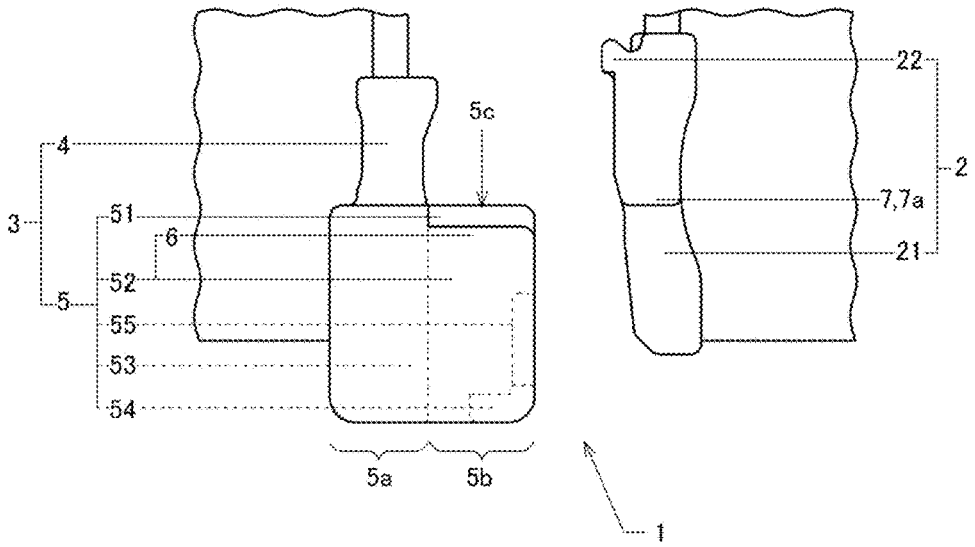
FIG. 11A depicts an open state of an opener that is to be used for a slide fastener according to a second illustrative embodiment of the present invention, as seen from below.
Figure 11B:
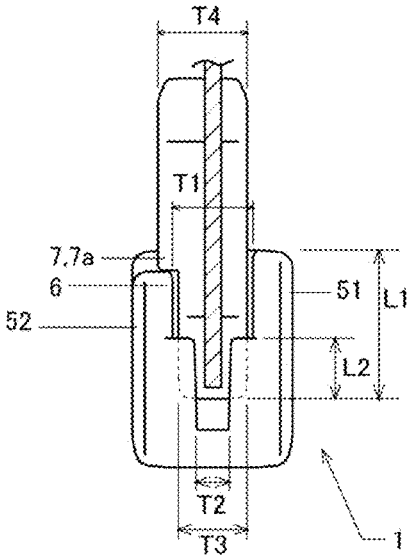
FIG. 11B is a side view depicting a closed state of the opener.

The slide fastener 11 according to a second illustrative embodiment of the present invention is the same as the first illustrative embodiment as to the pair of fastener stringers 12, 12 and the slider 13, and is different from the first illustrative embodiment as to the opener 1. As shown in FIG. 11, the opener 1 of the second illustrative embodiment is different from the opener 1 of the first illustrative embodiment as to the pair of restriction parts 6, 7. In the opener 1 of the first illustrative embodiment, the pair of restriction walls 6*a*, 6*b* protrudes from the upper wall 51 and the lower wall 52 toward the separable pin hole with respect to the upper-lower direction. However, the pair of restriction walls 6*a*, 6*b* is not provided for the opener 1 of the second illustrative embodiment. Instead, in the opener 1 of the second illustrative embodiment, one restriction part 6 is configured as the front end portion of the lower wall 52, and the front end, which faces toward the separable pin accommodation part 5*b*, of the lower wall 52, is positioned at the rear of the front end of the upper wall 51.

Also, the other restriction part 7 is configured so that the front part of the separable pin 2 is thicker than the rear part of the separable pin 2 (a part to be accommodated in the separable pin accommodation part 5*b*) in the upper-lower direction. More specifically, the front part of the separable pin 2 has a stepped portion 7*a* protruding toward the lower side (left side, in FIG. 11B) in the upper-lower direction beyond the rear part of the separable pin 2, and the stepped portion 7*a* configures the restriction part 7 of the separable pin-side. Also, a thickness dimension (maximum thickness dimension) T4 in the upper-lower direction of the stepped portion 7*a*, which is the front part of the separable pin 2, the spaced dimension T1 between the upper wall 51 and the lower wall 52, the width dimension (spaced dimension between the pair of wall parts 55, 55) T2 of the tape groove 5*d* and the thickness dimension (the width dimension in the upper-lower direction) T3 of the separable pin 2 are formed to satisfy a relation of T4>T1>T3>T2.

According to the opener 1 of the second illustrative embodiment, when the rear part of the separable pin 2 is inserted into the separable pin hole 5*c*, a lower end face of the stepped portion 7*a* of the separable pin 2 collides with the front end face of the upper wall 51, so that the position of the rearmost end of the separable pin 2 to be inserted into the separable pin hole 5*c* is restricted. In the meantime, the opener 1 of the second illustrative embodiment and openers of illustrative embodiments to be described later are configured to satisfy the relation of ½ L1≥L2 and the relation of L2<W, like the first illustrative embodiment.

Figure 12A:
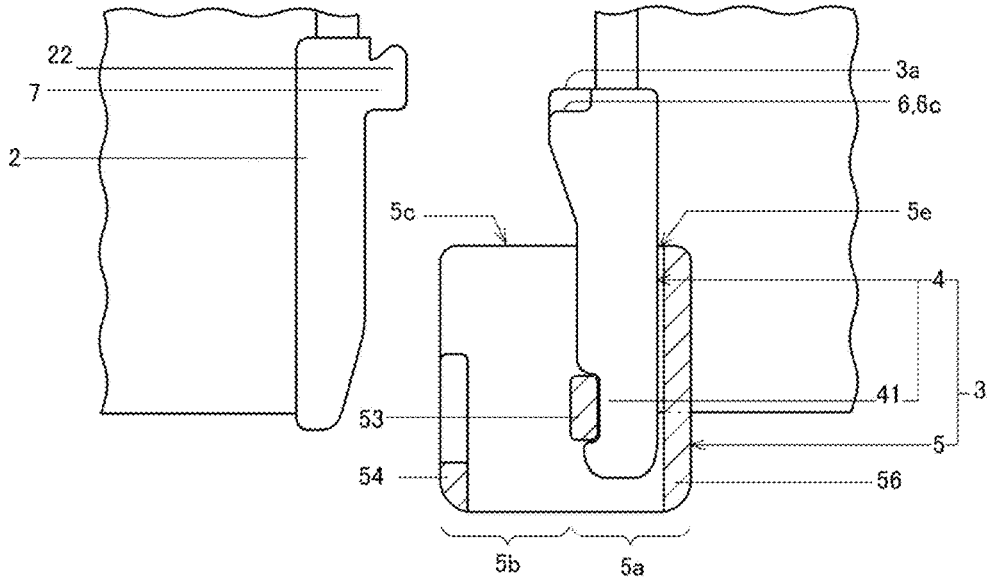
FIG. 12A is a plan view depicting an open state of an opener that is to be used for a slide fastener according to a third illustrative embodiment of the present invention.
Figure 12B:
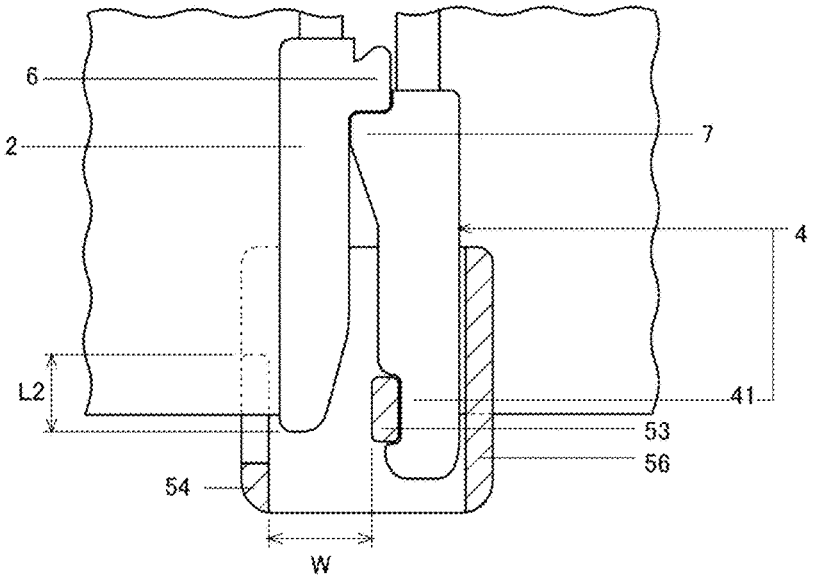
FIG. 12B is a plan view depicting a closed state of the opener.

The slide fastener 11 according to a third illustrative embodiment of the present invention is the same as the first illustrative embodiment as to the pair of fastener stringers 12, 12 and the slider 13, and is different from the first illustrative embodiment as to the opener 1. As shown in FIG. 12, the opener 1 of the third illustrative embodiment of the present invention is different from the opener 1 of the first illustrative embodiment as to the pair of restriction parts 6, 7 and the retainer 3.

According to the opener 1 of the first illustrative embodiment, the pair of restriction walls 6*a*, 6*b* protrudes from the upper wall 51 and the lower wall 52 toward the separable pin hole with respect to the upper-lower direction. However, the pair of restriction walls 6*a*, 6*b* is not provided for the opener 1 of the third illustrative embodiment. Instead, according to the opener 1 of the third illustrative embodiment, one restriction part 7 is configured as a rear part of the meshing protrusion 22 formed at the front end portion of the separable pin 2 on the surface facing toward the retainer pin joining part with respect to the right-left direction and a rear surface of the rear part is configured as a surface orthogonal to the front-rear direction in the shown example. Also, the other restriction part 6 is configured as the stepped portion 6*c* formed on the front surface of the retainer pin 4, and the rear part of the meshing protrusion 22 is to collide with the same. The stepped portion 6*c* is opened forward toward the separable pin hole-side of the right-left direction. Also, a rear surface of the stepped portion 6*c* is configured as a planar surface orthogonal to the right-left direction. Also, an intermediate portion in the upper-lower width of the stepped portion 6*c* is formed with the engagement protrusion 3*a* configured to partition the upper and lower over an entire length in the front-rear direction of the stepped portion 6*c*. In the meantime, an intermediate portion in the upper-lower width of the rear part of the meshing protrusion 22 configured to collide with the stepped portion 6*c* is also formed with the engagement groove 2*h* to be fitted into the engagement protrusion 3*a* and opened rearward toward the retainer pin-side of the right-left direction.

Regarding the retainer 3, the retainer pin 4 and the retainer body 5 are integrally formed in the opener 1 of the first illustrative embodiment but the retainer pin 4 and the retainer body 5 are separately formed in the opener 1 of the third illustrative embodiment.

The retainer body 5 is not directly fixed to the tape 12*a* of the fastener stringer 12 and is fixed to the tape 12*a* via the retainer pin 4. The retainer pin joining part 5*a* of the retainer body 5 has a joining sidewall 56 configured to join the upper wall 51 and the lower wall 52 therebetween at an opposite side to the separable pin hole 5*c* with respect to the right-left direction, and an inner wall 53 configured to join the upper wall 51 and the lower wall 52 therebetween at an intermediate portion in the front-rear direction of the separable pin-side with respect to the right-left direction, in addition to the upper wall 51 and the lower wall 52. Regarding the space formed between the upper wall 51 and the lower wall 52, a retainer pin hole 5*e* is formed by front and rear spaces with respect to the inner wall 53 and a space closer to the joining sidewall 56 relative to the inner wall 53. Also, regarding the space formed between the upper wall 51 and the lower wall 52, a space closer to the pair of wall parts 55, 55 relative to the inner wall 53 with respect to the right-left direction becomes the separable pin hole 5*c*. In the meantime, the bottom wall 54 is configured to join the upper wall 51 and the lower wall 52 only within a formation range of the wall parts 55, 55 with respect to the right-left direction.

The retainer pin 4 is fixed to the core part 12*b* of the tape 12*a* of the fastener stringer 12. The front part of the retainer pin 4 is a part protruding forward beyond the retainer pin joining part 5*a*. Also, the rear part of the retainer pin 4 is a part to be accommodated in the retainer pin joining part 5*a* (a part to be inserted into the retainer pin hole 5*e*), and a separable pin hole-side surface of the side surfaces thereof is formed with a fitting concave portion 41 to be fitted to the inner wall 53.

When assembling the retainer 3 by the retainer pin 4 and the retainer body 5, which are separate members, the rear part of the retainer pin 4 is inserted into the retainer pin hole 5*e* of the retainer body 5 from the front thereof and the fitting concave portion 41 of the retainer pin 4 and the inner wall 53 of the retainer body 5 are fitted. Thereby, the retainer pin 4 and the retainer body 5 are joined and integrated, so that the retainer 3 is formed.

According to the opener 1 of the third illustrative embodiment, when the rear part of the separable pin 2 is inserted into the separable pin hole 5*c* of the integrated retainer 3, the rear end face of the restriction part 7, which is the rear part of the meshing protrusion 22 of the separable pin 2, collides with a bottom of the stepped portion 6*c* of the front part of the retainer pin 4, so that the position of the rearmost end of the separable pin 2 to be inserted into the separable pin hole 5*c* is restricted.

Figure 13:
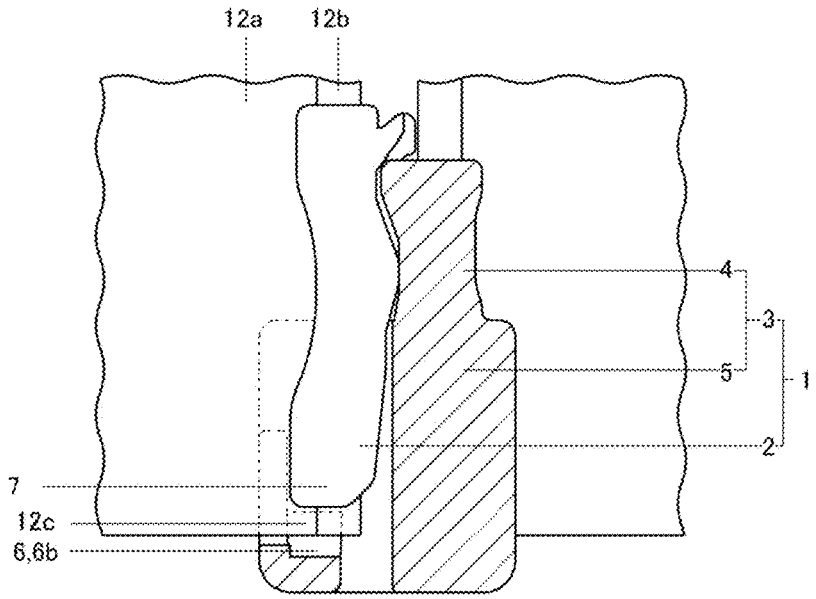
FIG. 13 is a plan view depicting an open state of an opener that is to be used for a slide fastener according to a fourth illustrative embodiment of the present invention.

The slide fastener 11 according to a fourth illustrative embodiment of the present invention is the same as the first illustrative embodiment as to the slider 13 and the opener 1, and is different from the first illustrative embodiment as to the pair of fastener stringers 12, 12. More specifically, regarding the fastener stringer 12 of the separable pin-side, the rear end of the tape 12*a* is positioned in front of the rear end of the separable pin 2, in the first illustrative embodiment. However, in the fourth illustrative embodiment, as shown in FIG. 13, the tape 12*a* is made to extend rearward beyond the separable pin 2, including the core part 12*b*, so that the rear end of the tape 12*a* extends rearward beyond the rear end of the separable pin 2. That is, the rear end portion of the tape 12*a* is configured as an extension piece portion 12*c* further extending rearward beyond the separable pin 2. In the closed state of the opener 1, the extension piece portion 12*c* is accommodated in the tape groove 5*d* between the pair of restriction walls 6*a*, 6*b* and between the pair of wall parts 55, 55. Also, a rear end of the extension piece portion 12*c* is a straight line parallel in the right-left direction, and a gap is formed between the rear end and the front end of the bottom wall 54.

Figure 14:
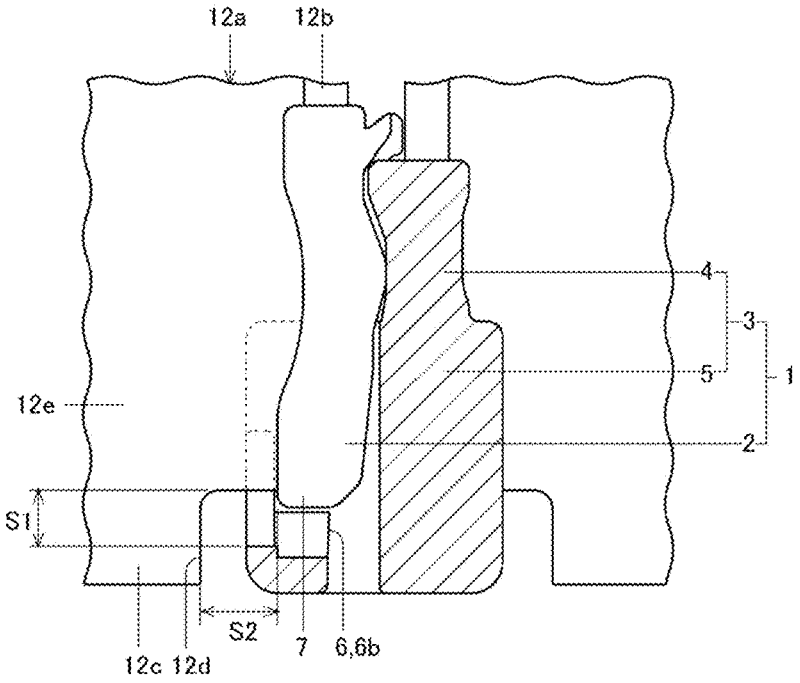
FIG. 14 is a plan view depicting a closed state of an opener that is to be used for a slide fastener according to a fifth illustrative embodiment of the present invention.
Figure 15:
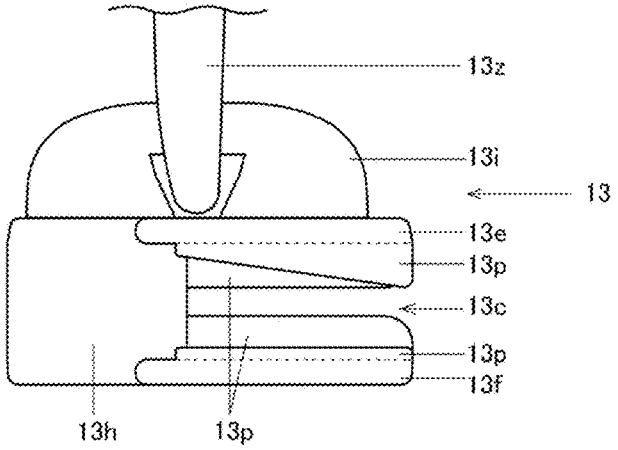
FIG. 15 is a side view depicting a slider that is to be used for a slide fastener according to a sixth illustrative embodiment of the present invention.

The slide fastener 11 according to a fifth illustrative embodiment of the present invention is the same as the first illustrative embodiment as to the slider 13 and the opener 1, and is different from the first illustrative embodiment as to the pair of fastener stringers 12, 12. More specifically, regarding the fastener stringer 12 of the separable pin-side, the rear end of the tape 12*a* is positioned in front of the rear end of the separable pin 2 and is a straight line parallel in the right-left direction in the first illustrative embodiment. However, in the fifth illustrative embodiment, as shown in FIG. 14, the rear end of the tape 12*a* is made to further extend rearward beyond the rear end of the separable pin 2, except for the vicinity of the separable pin 2 with respect to the right-left direction, and is positioned in front of the rear end of the separable pin 2 in the vicinity of the separable pin 2 with respect to the right-left direction. That is, the tape 12*a* has a band-shaped tape main body portion 12*e* positioned in front of the rear end of the separable pin and the extension piece portion 12*c* extending rearward from a position distant from a rear end of the band-shaped tape main body portion 12*e* with respect to the separable pin 2 in the right-left direction. Therefore, the core part-side with respect to the right-left direction, which is the rear end portion of the tape 12*a*, is formed with an L-shaped notched portion 12*d*, which is formed by a side end of the extension piece portion 12*c* and the rear end of the tape main body portion 12*e*.

According to the slide fastener 11 of the fifth illustrative embodiment, when the opener 1 is in the closed state, a gap S1 is formed in the upper-lower direction between the rear end of the tape 12*a* positioned at the notched portion 12*d* with respect to the right-left direction and the bottom wall 54, and a gap S2 is formed in the right-left direction between the extension piece portion 12*c* and the bottom wall 54. Therefore, when shifting the opener 1 from the closed state to the open state by the external force, even though the separable pin 2 is rotated and the tape 12*a* is correspondingly rotated together with the extension piece portion 12*c*, it is possible to prevent the extension piece portion 12*c* from contacting the bottom wall 54 as much as possible.

The slide fastener 11 according to a sixth illustrative embodiment of the present invention is the same as the first illustrative embodiment as to the pair of fastener stringers 12, 12 and the opener 1, and is different from the first illustrative embodiment as to the slider 13. More specifically, regarding the slider 13 of the first illustrative embodiment, the tape insertion path 13*c* from which the element row 12*h* is separated by the external force has the constant upper-lower width parallel with the front-rear direction. However, according to the slider 13 of the sixth illustrative embodiment, the upper-lower width of the tape insertion path 13*c* is gradually narrowed from the front toward the rear. In the shown example, the upper flange of the pair of flanges 13*p*, 13*p* forming the tape insertion path 13*c* from which the element row 12*h* is to be separated has a downward protruding length that becomes longer toward the rear, and the lower flange has an upward protruding length that is the same over the entire length in the front-rear direction.

The present invention is not limited to the above illustrative embodiments, and can be appropriately changed without departing from the gist thereof. For example, the other restriction part 6 of the first illustrative embodiment has the pair of restriction walls 6*a*, 6*b*. However, the present invention is not limited thereto, and the other restriction part may have only the upper restriction wall 6*a* or lower restriction wall 6*b*.

DESCRIPTION OF REFERENCE NUMERALS

1: Opener
2: Separable Pin
21: Separable Pin Main Body Portion
22: Meshing Protrusion
2*a*: First Surface
2*b*: Second Surface
2*c*: Third Surface
2*h*: Engagement Groove
2*i*: First Engagement Surface
2*j*: Second Inclined Surface
2*p*: Rounded Corner Surface
3: Retainer
4: Retainer Pin
3*a*: Engagement Protrusion
3*b*: First Engaged Surface
3*c*: Second Engaged Surface
41: Fitting Concave Portion
5: Retainer Body
5*a*: Retainer Pin Joining Part
5*b*: Separable Pin Accommodation Part
5*c*: Separable Pin Hole
5*d*: Tape Groove
5*e*: Retainer Pin Hole

51: Upper Wall
52: Lower Wall
53: Inner Wall
54: Bottom Wall
54*a*: Bottom Wall-Horizontally Extending Portion
54*b*: Bottom Wall-Vertically Extending Portion
55: Wall Part
56: Joining Sidewall
6: Restriction Part
6*a*: Upper Restriction Wall
6*b*: Lower Restriction Wall
6*c*: Stepped Portion
7: Restriction Part
7*a*: Stepped Portion
11: Slide Fastener
12: Fastener Stringer
12*a*: Tape
12*b*: Core Part
12*c*: Extension Piece Portion
12*d*: Notched Portion
12*e*: Tape Main Body Portion
12*h*: Element Row
12*i*: Element
12*p*: Stop
13: Slider
13*a*: Slider Body
13*b*: Element Path
13*c*: Tape Insertion Path
13*e*: Upper Blade
13*f*: Lower Blade
13*h*: Connecting Post
13*i*: Pull-Tap Attachment Portion
13*p*: Flange
13*q*: Inclined Surface
13*z*: Pull-Tap
S1: Gap In Upper-Lower Direction
S2: Gap In Right-Left Direction
L1: Width Dimension in Front-Rear Direction of Separable Pin to Be Accommodated in Separable Pin Accommodation Part
L2: Dimension from Rear End of Separable Pin Accommodated in Separable Pin Accommodation Part to Front Ends of Pair of Wall Parts
W: Width Dimension W in Right-Left Direction of Separable Pin Hole
T1: Spaced Dimension between Upper Wall and Lower Wall
T2: Width Dimension of Tape Groove
T3: Thickness Dimension of Separable Pin
T4: Thickness Dimension in Upper-Lower Direction of Stepped Portion of Separable Pin

The invention claimed is:

1. An opener of a slide fastener, configured to shift a pair of fastener stringers extending in a front-rear direction from a closed state to an open state by applying an external force in a right-left direction, which is a width direction thereof, the opener comprising:

a separable pin provided at a rear part of one of the fastener stringers; and a retainer provided at a rear part of the other of the fastener stringers and having a separable pin accommodation part formed with a separable pin hole through which the separable pin can be inserted and removed, wherein the separable pin accommodation part has an upper wall and a lower wall facing each other in an upper-lower direction, which is a thickness direction of the fastener stringers, a pair of wall parts protruding from the upper wall and the lower wall in a direction of narrowing an interval therebetween, and a bottom wall configured to join the upper wall and the lower wall at the rear of the pair of wall parts, wherein the pair of wall parts extends toward the bottom wall from a rear side relative to front ends of the upper wall and the lower wall, and wherein in a state where the separable pin is accommodated in the separable pin accommodation part, a pair of restriction parts configured to collide with each other so as to restrict a position of a rearmost end of the separable pin inserted into the separable pin hole to a position between the bottom wall and front ends of the pair of wall parts and to form a gap between the rearmost end of the separable pin and the bottom wall are separately provided for the retainer and the separable pin.

2. The opener of a slide fastener according to claim 1, wherein in the state where the separable pin is accommodated in the separable pin accommodation part, a dimension from a rear end of the separable pin to the front ends of the pair of wall parts is set shorter than a width dimension in the right-left direction of the separable pin hole.

3. The opener of a slide fastener according to claim 2, wherein the dimension from the rear end of the separable pin to the front ends of the pair of wall parts is set to a half or less of a dimension in the front-rear direction of the separable pin to be accommodated in the separable pin accommodation part.

4. The opener of a slide fastener according to claim 2, wherein one of the restriction parts is a rear end portion of the separable pin, and wherein the other of the restriction parts is a pair of restriction walls protruding from opposing surfaces of the upper wall and the lower wall between the bottom wall and the front ends of the pair of wall parts.

5. The opener of a slide fastener according to claim 2, wherein mutually opposing surfaces of the separable pin and the pair of wall parts are configured as planar surfaces orthogonal to the right-left direction.

6. The opener of a slide fastener according claim 2, wherein within a range in the right-left direction between the pair of wall parts, the bottom wall is arranged at the rear of a rear end of a tape of the fastener stringer, to which the separable pin is fixed.

7. A slide fastener comprising:

a pair of fastener stringers extending in a front-rear direction;

the opener according to claim 2, and a slider configured to move along a pair of element rows provided at opposing side edge portions of the pair of fastener stringers, wherein when an external force in the right-left direction is applied to the pair of fastener stringers in which the pair of element rows are meshed with each other, in the vicinity of the slider, at least one of an upper blade and a lower blade of the slider, which face each other in the upper-lower direction, is bent, one of the element rows is pulled out laterally from between the upper blade and the lower blade and the pair of element rows are separated.

* * * * *